US010297945B2

(12) United States Patent
Yamane

(10) Patent No.: US 10,297,945 B2
(45) Date of Patent: May 21, 2019

(54) CONNECTOR AND CONNECTOR ASSEMBLY

(71) Applicant: Tyco Electronics Japan G.K., Kanagawa (JP)

(72) Inventor: Tomokazu Yamane, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 16/153,142

(22) Filed: Oct. 5, 2018

(65) Prior Publication Data

US 2019/0109401 A1 Apr. 11, 2019

(30) Foreign Application Priority Data

Oct. 5, 2017 (JP) ..... 2017-194786

(51) Int. Cl.
*H01R 13/44* (2006.01)
*H01R 13/62* (2006.01)
*H01R 13/629* (2006.01)

(52) U.S. Cl.
CPC ..... *H01R 13/44* (2013.01); *H01R 13/62955* (2013.01)

(58) Field of Classification Search
CPC ..... H01R 13/44; H01R 3/62933; H01R 13/62938; H01R 13/62955
USPC ..... 439/157
See application file for complete search history.

(56) References Cited

U.S. PATENT DOCUMENTS

| | | | | |
|---|---|---|---|---|
| 6,755,673 | B2 | 6/2004 | Fukushima et al. | |
| 8,734,170 | B2 | 5/2014 | Ikeda et al. | |
| 2004/0192090 | A1 | 9/2004 | Flowers et al. | |
| 2005/0098419 | A1 | 5/2005 | Matsui et al. | |
| 2013/0126205 | A1 | 5/2013 | Henmi | |
| 2017/0133790 | A1* | 5/2017 | Yamane | H01R 13/703 |

FOREIGN PATENT DOCUMENTS

| | | | |
|---|---|---|---|
| JP | 2002343169 | A | 11/2002 |
| JP | 201362042 | A | 4/2013 |
| JP | 201362043 | A | 4/2013 |

(Continued)

OTHER PUBLICATIONS

Abstract of JP2002343169, dated Nov. 29, 2002, 2 pages.

(Continued)

*Primary Examiner* — Khiem M Nguyen
(74) *Attorney, Agent, or Firm* — Barley Snyder

(57) ABSTRACT

A connector comprises an interlock busbar adapted to be inserted into an interlock connector and short-circuit a pair of first conducting wires of a mating connector, a clip busbar adapted to pinch and short-circuit a pair of terminals of the mating connector, a housing, a lever, and a slider supported on the housing and slidable between an unmating position and a mating position. The lever removes the short circuit of the pair of first conducting wires by pulling out the interlock busbar from the interlock connector according to a first-half turning operation. The slider at the mating position blocks a second-half turning operation by interfering with the lever at an end of the first-half turning operation of the lever, and allows the second-half turning operation of the lever after a sliding operation of the slider to the unmating position.

6 Claims, 15 Drawing Sheets

(56) References Cited

FOREIGN PATENT DOCUMENTS

| | | | |
|---|---|---|---|
| JP | 2014-56794 | A | 3/2014 |
| JP | 201791805 | A | 5/2017 |
| KR | 101479054 | B1 | 1/2015 |

OTHER PUBLICATIONS

Abstract of JP2013062043, dated Apr. 4, 2013, 2 pages.
Extended European Search Report, European Patent Application No. 18198577.1, dated Jan. 31, 2019, 9 pages.
Abstract of JP2014-56794, dated Mar. 27, 2014, 1 page.
Abstract of KR 101479054 B1, dated Jan. 7, 2015, 1 page.

* cited by examiner

CONNECTOR AND CONNECTOR ASSEMBLY

CROSS-REFERENCE TO RELATED APPLICATIONS

This application claims the benefit of the filing date under 35 U.S.C. § 119(a)-(d) of Japanese Patent Application No. 2017-194786, filed on Oct. 5, 2017.

FIELD OF THE INVENTION

The present invention relates to a connector and, more particularly, to a connector having a lever.

BACKGROUND

A battery mounted on an electric vehicle or a hybrid vehicle, for example, is mounted with a service plug for interrupting electrical conduction between a power supplying portion in the battery and a loading portion composed of an electrical system in the vehicle. This service plug is a connector for ensuring working safety during maintenance of the electrical system in the vehicle. The service plug includes a cap connector connected to the power supplying portion side and a plug connector so mated with the cap connector as to be capable of being unmated therefrom. In the maintenance work for the vehicle, the plug connector is detached from the cap connector. Thereby, power feeding to the electrical system in the vehicle is interrupted, so that the safety of an operator is ensured.

The cap connector has a pair of terminals and an interlock connector. Each of the pair of terminals is fixed to each of ends of two conducting wires through which a high current flows. The terminals are short-circuited to each other, and such a high current as 100 A, for example, flows through these two conducting wires. In addition, the interlock connector retains one ends of two signal lines. The interlock connector controls on/off switching of a high current flowing through the terminals. When the two signal lines retained by this interlock connector are short-circuited, a high current flows through the terminals; when the short circuit of the two signal lines is removed, the high current flowing through the terminals is interrupted.

Upon being mated with the cap connector, the plug connector short-circuits the pair of terminals of the cap connector and also short-circuits the two signal lines. Such a service plug, for example, is disclosed in Japanese Patent Application No. 2002-343169A. In order to be unmated from the cap connector, the plug connector constituting the above service plug is required to, first of all, remove the short circuit of the two signal lines to reliably interrupt the current flowing the terminals, and then remove the short circuit of the terminals. In this regard, a period of time equal to or longer than a certain period of time is required until the current flowing through the terminals is reliably interrupted after the short circuit of the signal lines is removed. Therefore, in order to be detached from the cap connector, the plug connector is required to have a structure for reliably ensuring the above period of time equal to or longer than the certain period of time has taken place before the short circuit of the terminals is removed after the short circuit of the signal lines is removed.

In the service plug disclosed in JP 2002-343169A, the above period of time equal to or longer than the certain period of time is intended to be ensured by a lifting operation and a sliding operation of a lever. However, the lifting operation and the sliding operation of the lever can be continuously performed, so that it is difficult to reliably ensure that the above period of time equal to or longer than the certain period of time has taken place, and current flowing through the terminals is not reliably interrupted.

SUMMARY

A connector comprises an interlock busbar adapted to be inserted into an interlock connector and short-circuit a pair of first conducting wires of a mating connector, a clip busbar adapted to pinch and short-circuit a pair of terminals of the mating connector, a housing, a lever, and a slider supported on the housing and slidable between an unmating position and a mating position. The lever removes the short circuit of the pair of first conducting wires by pulling out the interlock busbar from the interlock connector according to a first-half turning operation. The slider at the mating position blocks a second-half turning operation by interfering with the lever at an end of the first-half turning operation of the lever, and allows the second-half turning operation of the lever after a sliding operation of the slider to the unmating position.

BRIEF DESCRIPTION OF THE DRAWINGS

The invention will now be described by way of example with reference to the accompanying Figures, of which:

FIG. 6A-1 is a perspective view of a start of mating the cap connector with the plug connector;

FIG. 6A-2 is a top view of FIG. 6A-1;

FIG. 6B-1 is a perspective view of the cap connector and the plug connector after mating;

FIG. 6B-2 is a top view of FIG. 6B-1;

FIG. 6C-1 is a perspective view of the cap connector and the plug connector after locking;

FIG. 6C-2 is a top view of FIG. 6C-1;

FIG. 11A-1 is a perspective view of a state after a first-half turning operation of the lever from the mating state of the cap connector and the plug connector;

FIG. 11A-2 is a top view of FIG. 11A-1;

DETAILED DESCRIPTION OF THE EMBODIMENT(S)

Figure 1:
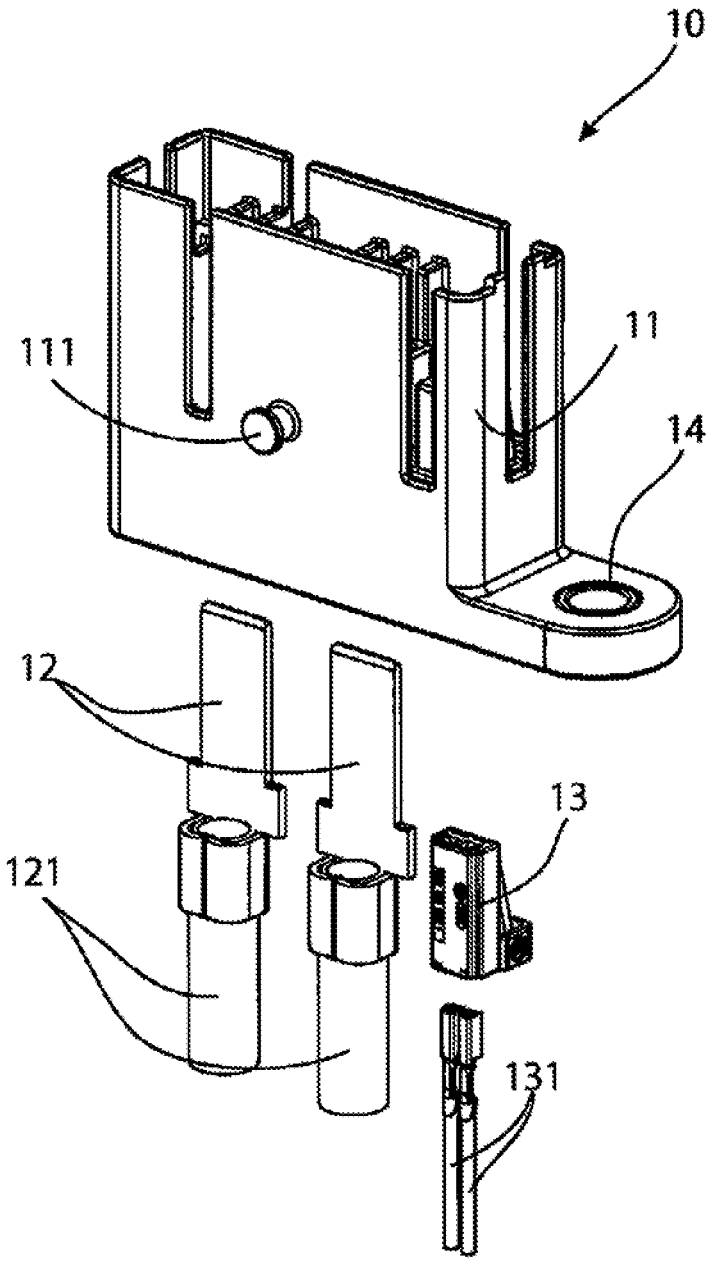
FIG. 1 is an exploded perspective view of a cap connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A cap connector 10 according to an embodiment is shown in FIG. 1. The cap connector 10 may also be referred to as a mating connector or a first connector. The cap connector 10 includes a housing 11, a pair of terminals 12, and an interlock connector 13. The pair of terminals 12 are fixed to respective ends of two conducting wires 121 for power transmission. The two conducting wires 121 may also be referred to as second conducting wires. The interlock connector 13 retains ends of two conducting wires 131 for signal transmission. The two conducting wires 131 may also be referred to as first conducting wires. The pair of terminals 12 and the interlock connector 13 are accommodated in the housing 11.

The housing 11, as shown in FIG. 1, has a pair of bosses 111 protruding from a pair of opposite outer wall faces at both sides of the housing 11. In addition, a collar 14 having a hollow shape is press-fitted in the housing 11. The collar 14 is a threaded hole for mounting of the cap connector 10. The housing 11 may also be referred to as a mating housing 11 of the cap connector 10.

The cap connector 10 is a connector to be attached to a battery or power supplying portion side of an electric vehicle or a hybrid vehicle. The cap connector 10 is configured to be mated with a plug connector 20 shown in FIG. 2. The cap connector 10 and plug connector 20 form a connector assembly.

When mated, as described in greater detail below, the plug connector 20 first short-circuits the pair of terminals 12, and thereafter short-circuits the two conducting wires 131 of the interlock connector 13. In addition, when being unmated from the cap connector 10, the plug connector 20 first removes the short circuit of the two conducting wires 131 of the interlock connector 13. Then, after a period of time equal to or longer than a predetermined period of time elapses, the short circuit of the pair of terminals 12 is removed. By unmating the plug connector 20 from the cap connector 10, power supply from the battery or power supplying portion to an electrical system or loading portion of the vehicle is interrupted.

Figure 2:
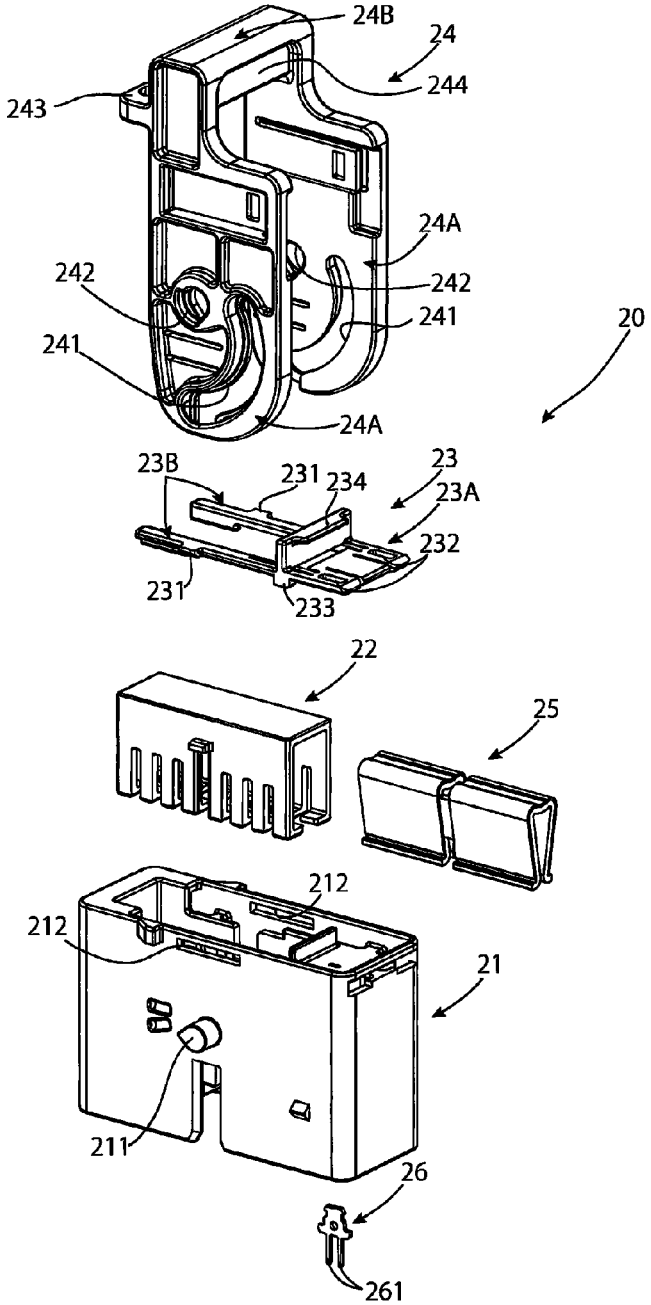
FIG. 2 is an exploded perspective view of a plug connector according to an embodiment.

The plug connector 20 is shown in FIG. 2. The plug connector 20 may also be referred to as a connector or a second connector. The plug connector 20 has an outer housing 21, an inner housing 22, a slider 23, a lever 24, a clip busbar 25, and an interlock busbar 26. The outer housing 21 and inner housing 22 may also be referred to as a housing 21, 22 of the plug connector 20.

The clip busbar 25 functions to pinch the pair of terminals 12 of the cap connector 10, shown in FIG. 1, and short-circuits the pair of terminals 12. The interlock busbar 26 has two male contact portions 261 inserted into the interlock connector 13 at the time of mating, and short-circuits the two conducting wires 131. The inner housing 22 retains the clip busbar 25. The inner housing 22 is accommodated in the outer housing 21 while retaining the clip busbar 25. The interlock busbar 26 is also accommodated in the outer housing 21. The outer housing 21 may also be referred to as a first housing.

As shown in FIG. 2, the outer housing 21 has a pair of bosses 211 protruding from opposite outer wall faces. Slots 212 are provided in upper portions of both side faces of the outer housing 21.

The slider 23, as shown in FIG. 2, has slide ribs 231; the slider 23 is supported on the outer housing 21 by inserting the slide ribs 231 into the slots 212 of the outer housing 21. The slider 23 then moves along the slots 212 of the outer housing 21 between an unmating position and a mating position described later by a sliding operation.

The lever 24, as shown in FIG. 2, has a pair of cam plates 24A so positioned in a mirror symmetrical manner with respect to each other as to extend along both the respective side faces of the outer housing 21, and a beam portion 24B connecting these cam plates 24A. The lever 24 is operated in a turning manner to function for mating and unmating of the plug connector 20 with and from the cap connector 10.

Figure 3A:
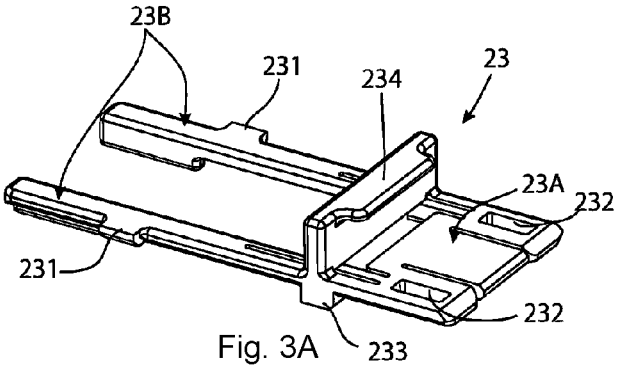
FIG. 3A is a front perspective view of a slider of the plug connector.
Figure 3B:
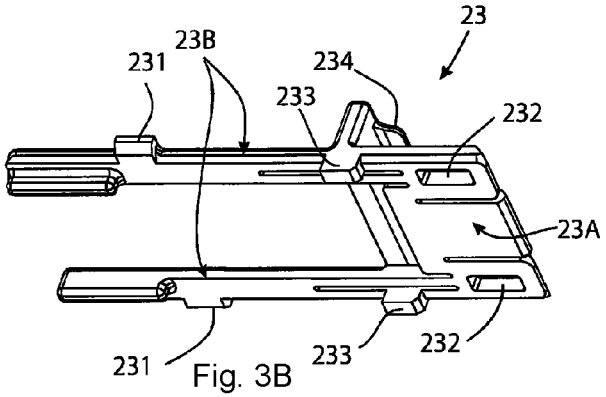
FIG. 3B is a bottom perspective view of the slider.
Figure 3C:
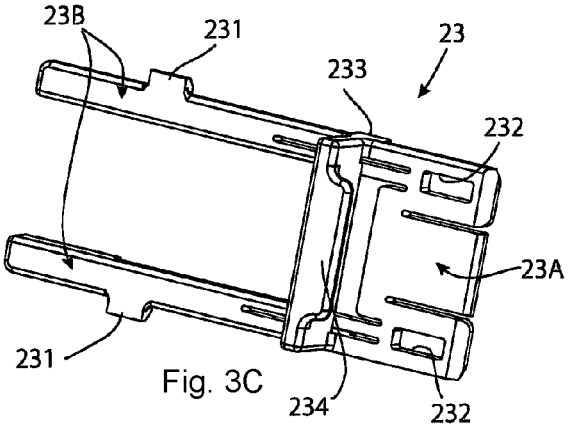
FIG. 3C is a top perspective view of the slider.

The slider 23 is shown in greater detail in FIGS. 3A-3C. The slider 23 has a lock portion 23A and two leg portions 23B extending from the lock portion 23A. The lock portion 23A functions to lock the slider 23 so that it cannot slide and to lock the lever 24 so that it cannot be turned. Catching holes 232, slide lock protrusions 233, and a finger catch portion 234 are provided on the lock portion 23A. The slide ribs 231 are disposed on the two leg portions 23B. The leg portions 23B function to support the slider 23 to the outer housing 21 by inserting the slide ribs 231 into the slots 212 of the outer housing 21. In addition, these two leg portions 23B have a structure elastically deflecting when the lock by the lock portion 23A is unlocked. The operation of the slider 23 is described in greater detail below.

Figure 4:
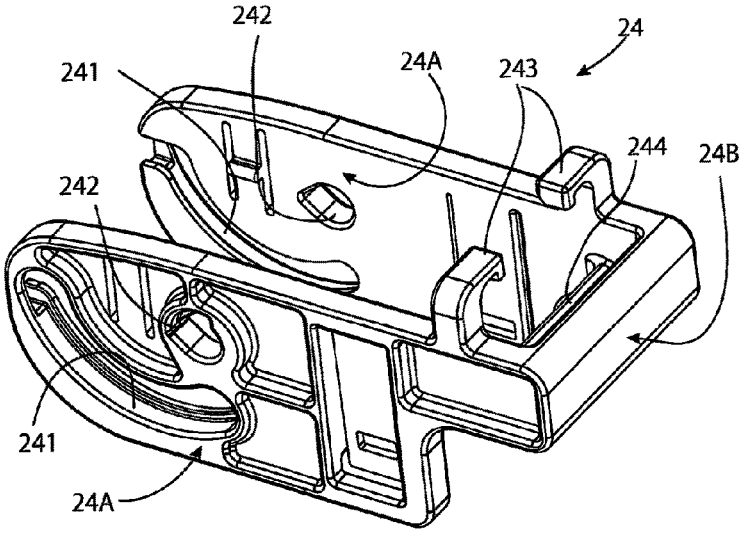
FIG. 4 is a perspective view of a lever of the plug connector.

The lever 24, as shown in FIG. 4, has the pair of cam plates 24A and the beam portion 24B connecting the cam plates 24A. Each of the pair of cam plates 24A has a cam groove 241 and a boss rotation hole 242. The boss 111 provided on the housing 11 of the cap connector 10 extends into the cam groove 241. The boss 211 provided on the outer housing 21 of the plug connector 20 extends into the boss rotation hole 242. When the lever 24 is turned in a mating direction, a cam action of the cam plate 23A causes the plug connector 20 to mate with the cap connector 10, whereas, by turning the lever 24 in the opposite direction, the plug connector 20 is unmated from the cap connector 10.

As shown in FIG. 4, a pair of hook portions 243 having a shape extending inward from right and left and then bending are provided on the lever 24. The hook portions 243 extend into the catching holes 232 of the slider 23 to lock the slider 24 when the lever 24 is in a horizontally inclined attitude shown in FIG. 4. A catching portion 244 is provided on the beam portion 24B of the lever 24. The catching portion 244 functions to abut against the slider when the lever 24 in a mating attitude is turned in a releasing direction, and temporarily block the lever 24 from being turned further.

Figure 5:
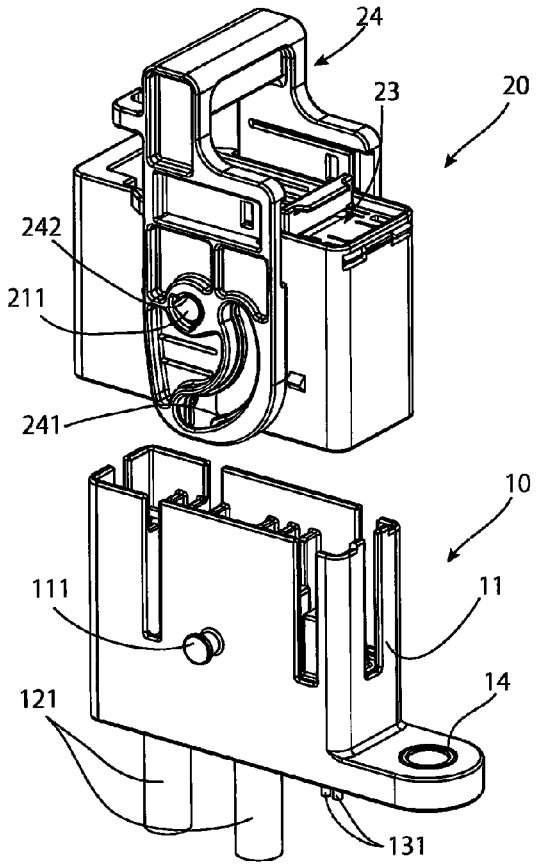
FIG. 5 is a perspective view of the cap connector and the plug connector.

The cap connector 10 and the plug connector 20 are shown in their mating orientations before mating in FIG. 5. The interlock connector 13 retaining the ends of the two conducting wires 131 for signal transmission and the pair of terminals 12 fixed to the respective distal ends of the two conducting wires 121 for power transmission are retained in the housing 11 of the cap connector 10.

In the mating orientations shown in FIG. 5, the inner housing 22 retaining the clip busbar 25 and the interlock busbar 26 are accommodated in the outer housing 21 of the plug connector 20. In addition, the slider 23 is placed in an upper portion of the outer housing 21. The slider 23 is at the unmating position in a state before mating. The lever 24 is positioned having the cam plates 23A extending along the side walls of the outer housing 21. Moreover, the bosses 211 of the outer housing 21 are located inside the boss rotation holes 242 of this lever 24. In this state before mating shown in FIG. 5, however, the bosses 111 of the housing 11 of the cap connector 10 are still not located inside the cam grooves 241 of the lever 24, and therefore the cam grooves 241 remain empty.

The plug connector 20 starts to mate with the cap connector 10 having the lever 24 vertically oriented, as shown in FIG. 5. The turning operation of this lever 24 in the mating direction is performed. Thereupon, first, the pair of terminals 12 are pinched by the clip busbar 25. By this pinch, the pair of terminals 12 are short-circuited. Then, by a further turning operation of the lever 24 after this pinch, the male contact portions 261 of the interlock busbar 26 are inserted into the interlock connector 13 to short-circuit the two conducting wires 131.

In addition, when the plug connector 20 is mated with the cap connector 10, a turning operation of the lever 24 in an unmating direction is performed. Thereupon, first of all, the interlock busbar 26 is pulled out from the interlock connector 13 and the short circuit of the two conducting wires 131 is removed. Thereafter, pinching of the pair of terminals 12 by the clip busbar 25 is removed.

FIG. 6(A-1) to 6(C-2) are views showing sequential operation of mating the cap connector 10 with the plug connector 20. FIGS. 6(A-1), 6(B-1), and 6(C-1) are isometric views showing states at the start of mating, after mating, and after locking, respectively. FIGS. 6(A-2), 6(B-2), and 6(C-2) are top views corresponding to FIGS. 6(A-1), 6(B-1), and 6(C-1), respectively.

Figures 1, 6A:
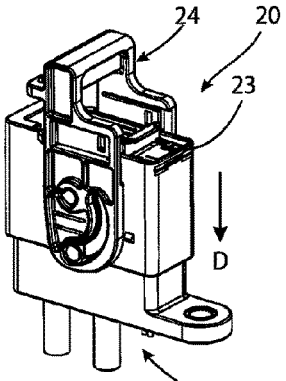
Figures 1, 6B:
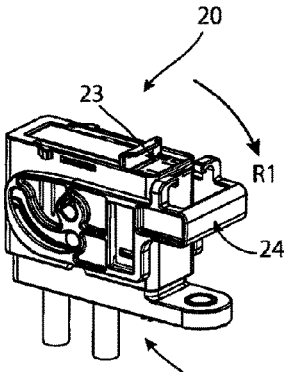
Figures 1, 6C:
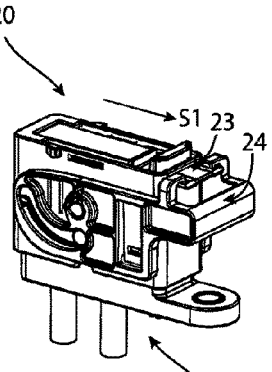
Figures 2, 6A:
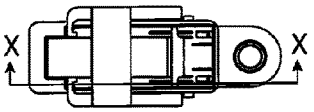
Figures 2, 6B:
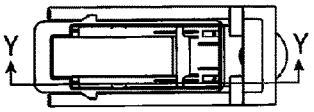
Figures 2, 6C:
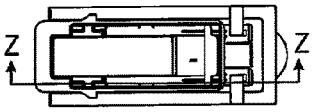

In order to start mating, the plug connector 20 is placed on the cap connector 10 having the lever 24 oriented vertically, as shown in FIG. 5, and is moved in the mating direction D shown in FIG. 6A-1. Thereupon, as shown in FIG. 6(A-1), the bosses 111 of the housing 11 of the cap connector 10 move into the cam grooves 241.

The lever 24 is then turned by 90 degrees in a direction of an arrow R1, as shown in FIG. 6(B-1). In the course of turning this lever 23 by 90 degrees, first of all, the two terminals 12 are pinched by the clip busbar 25, and further the interlock busbar 26 is inserted into the interlock connector 13.

Then, by sliding the slider 23 in a direction of an arrow S1 shown in FIG. 6(C-1), the slider 23 is moved from the unmating position shown in FIGS. 6(A-1) and 6(B-1) to the mating position shown in FIG. 6(C-1). By moving the slider 23 to this mating position, the plug connector 20 is locked in the state of being mated with the cap connector 10.

Figure 7:
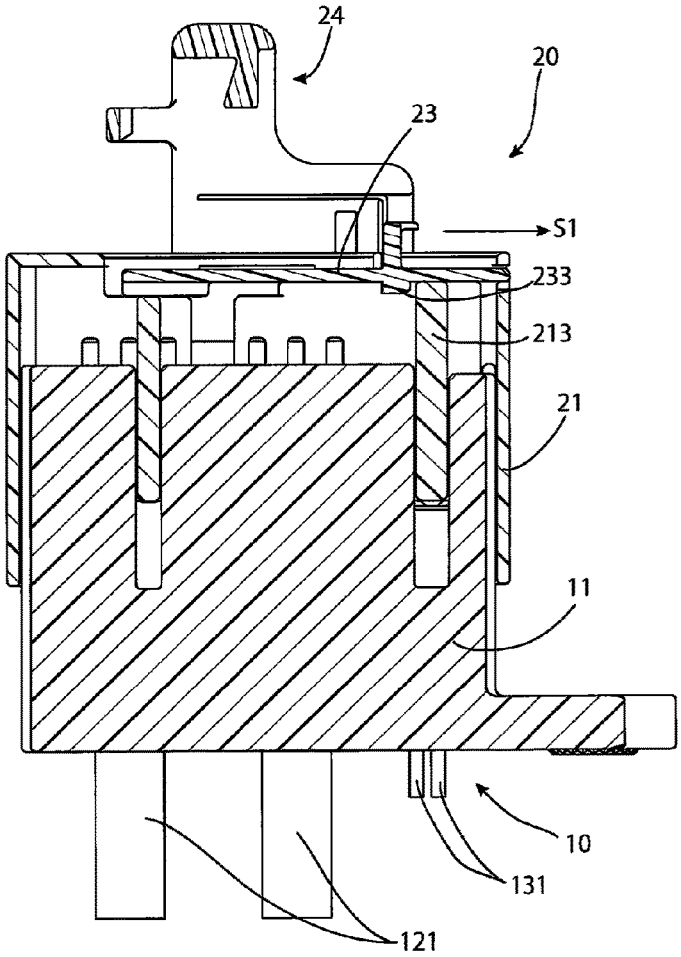
FIG. 7 is a sectional side view taken along arrows X-X of FIG. 6A-2.

FIG. 7 is a cross sectional view taken along arrows X-X shown in FIG. 6(A-2) at the start of mating. In FIG. 7, the slider 23 is in a separation position. The slider 23 slides in the direction of the arrow S1, thereby moving to the mating position. After moving to the mating position, the slide lock protrusions 233 of the slider 23 abut against an abutting wall 213 of the outer housing 21, so that the slider 23 cannot be slid further in the direction S1.

Figure 8:
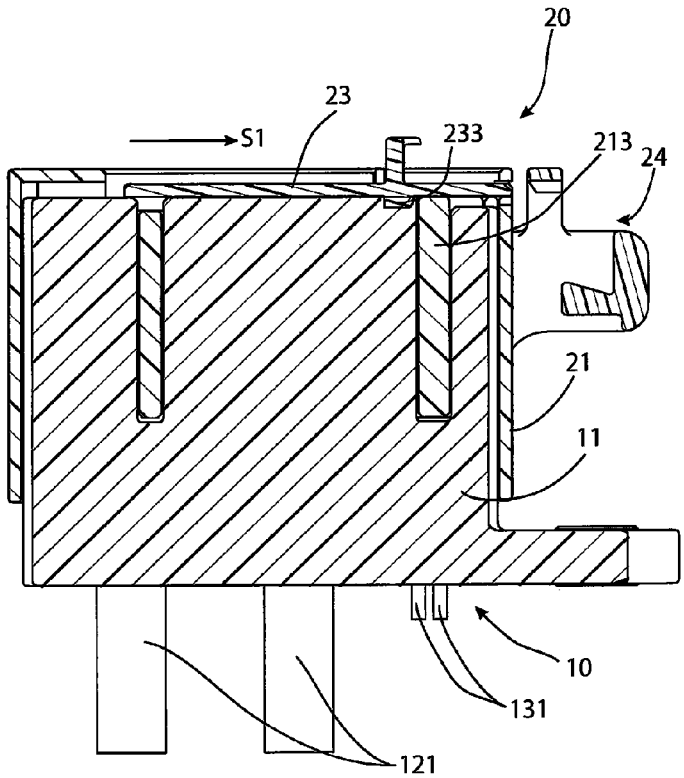
FIG. 8 is a sectional side view taken along arrows Y-Y of FIG. 6B-2.

FIG. 8 is a cross sectional view taken along arrows Y-Y shown in FIG. 6(B-2) after mating. The slider 23 is at the separation position in FIG. 8. In FIG. 8, however, the slide lock protrusions 233 of the slider 23 are at a position overlapping with an upper portion of the housing 11 of the cap connector 10. The slide lock protrusions 233 interfere with the housing 11 of the cap connector 10, thereby being pushed upward, and portions of the leg portions 23B of the slider 23 closer to the lock portion 23A than the slide ribs 231 inserted into the slots 212 of the outer housing 21 are deflected upward. This deflection removes the interference between the slider lock protrusions 233 and the abutting wall 213 of the outer housing 21. Thereby, the slider 23 becomes slidable in the direction of the arrow S1. A sliding operation of the slider 23 in the direction of the arrow S1 is performed in this state by a user.

Figure 9:
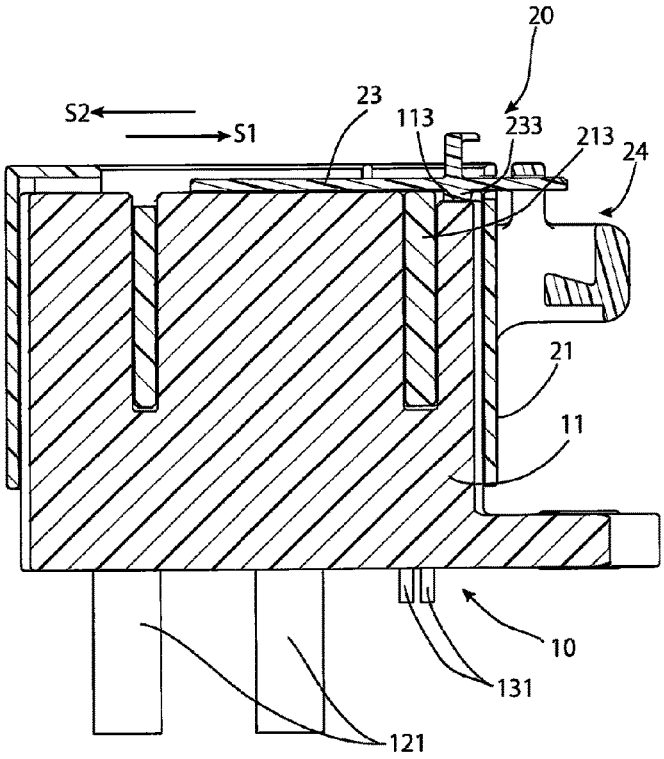
FIG. 9 is a sectional side view taken along arrows Z-Z of FIG. 6C-2.
Figure 10:
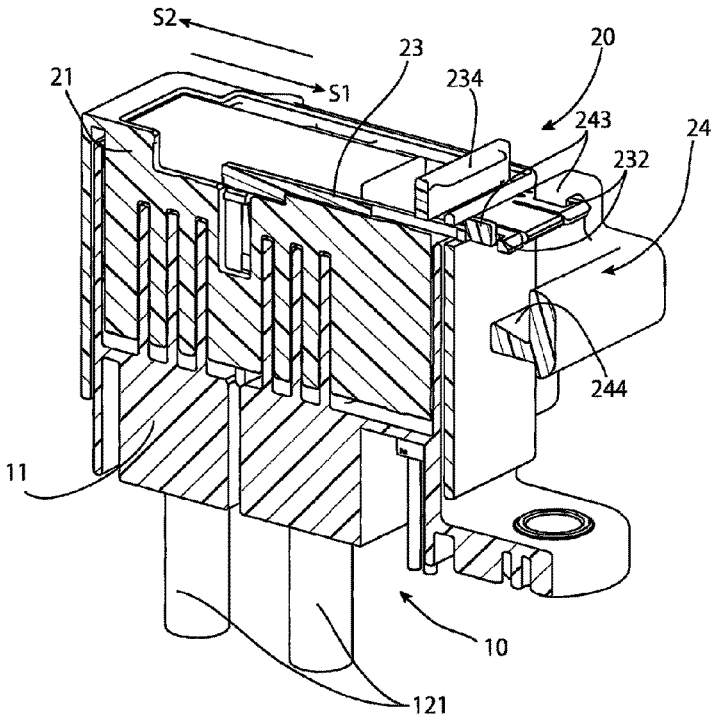
FIG. 10 is a sectional perspective view taken along arrows Z-Z of FIG. 6C-2.
Figures 1, 11A:
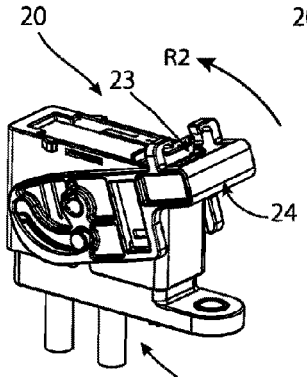
Figure 11B:
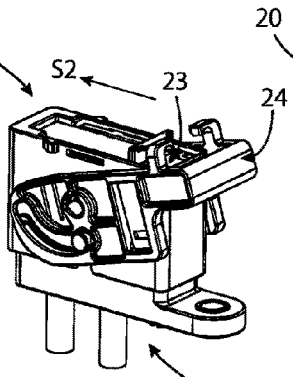
FIG. 11B is a perspective view of a state in which the slider has been moved to a separation position.
Figure 11C:
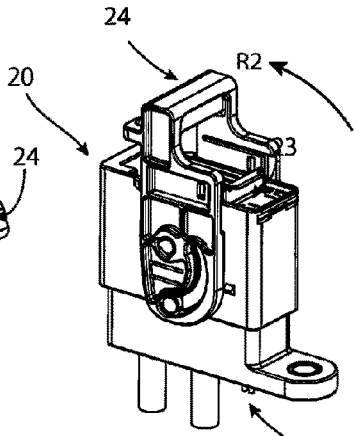
FIG. 11C is a perspective view of a state in which the slider has been moved to the separation position and after a second-half turning operation of the lever.
Figures 2, 11A:
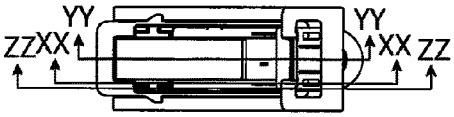

FIGS. 9 and 10 are a cross sectional view and a cross sectional isometric view, respectively, taken along arrows Z-Z shown in FIG. 6(C-2) after locking. The slider 23 slid to the mating position in the direction of the arrow S1 is shown in FIGS. 9 and 10. Once the slider 23 is slid to the mating position shown in FIGS. 9 and 10, the slide lock protrusions 233 of the slider 23 are located on a low-height portion 113 of the housing 11 of the cap connector 10. Thereby, the deflection of the slider 23 when passing over the abutting portion 213 is restored. This low-height portion 113 is below the abutting portion 213. Therefore, when the slider 23 is slid in a direction of an arrow S2 toward the separation position, this difference in height causes the slide lock protrusions 233 to abut against the abutting portion 213, thereby blocking the slider 23.

In addition, when the slider 23 is slid to the mating position in the direction of the arrow S1, the hook portions 243 of the lever 24 extend into the catching holes 232 of the slider 23. The slider 23 is also blocked from sliding in the direction of the arrow S2 toward the separation position by the hook portions 243 extending into the catching holes 232. In this manner, by sliding the slider 23 to the mating position, the cap housing 10 and the plug housing 20 are locked in their mated state.

FIGS. 11(A-1), 11(A-2), 11(B) and 11(C) show a sequential unmating operation. FIG. 11(A-1) is an isometric view showing a state after a first-half turning operation of the lever 24 in a direction of an arrow R2 from the state of being locked in the mating state shown in FIG. 6(C-1). FIG. 11(A-2) is a top view showing a state after the first-half turning operation of the lever 24, as is the case with FIG. 11(A-1). FIG. 11(B) is an isometric view showing a state in which the slider 23 has been further moved to the separation position in the direction of the arrow S2 after completion of the first-half turning operation shown in FIG. 11(A-1). FIG. 11(C) is an isometric view showing a state in which the slider 23 has been moved to the separation position, and further the lever 24 has been oriented vertically by performing a second-half turning operation of the lever 24 in the direction of the arrow R2. The same state as FIG. 6(A-1) at the start of mating is shown in FIG. 11(C).

As shown in FIGS. 11(A-1), 11(A-2), 11(B) and 11(C), in a separating operation, the first-half turning operation of the lever 24 is performed, the sliding operation of the slider 23 to the separation position is performed, and further the second-half turning operation of the lever 24 is performed.

Figure 12:
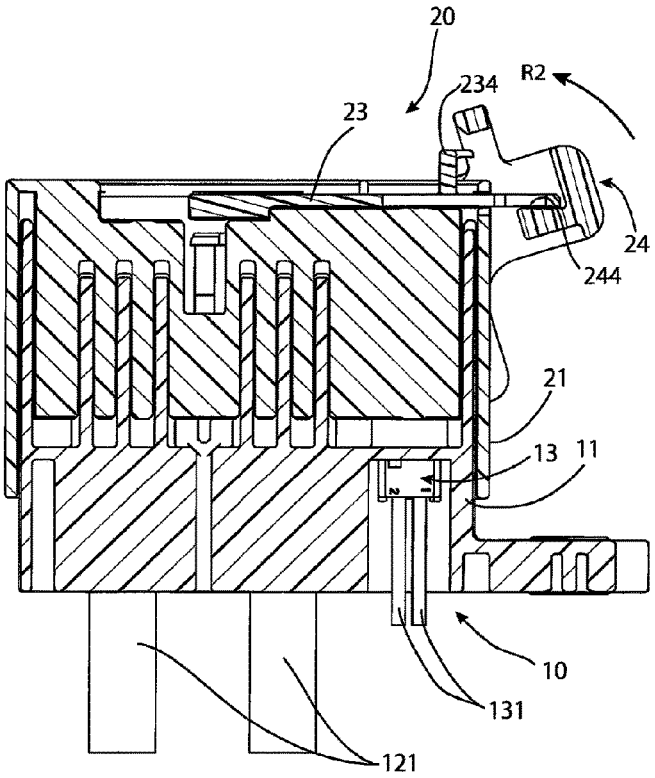
FIG. 12 is a side sectional view taken along arrows XX-XX of FIG. 11A-2.

FIG. 12 is a cross sectional view taken along arrows XX-XX shown in FIG. 11(A-2) after completion of the first-half turning operation. Once the separating operation is started and the turning operation of the lever 24 in the direction of the arrow R2 is performed, the catching portion 244 of the lever 24 abuts against the slider 23 at the end of the first-half turning operation. Thereby, the lever 24 can no longer be turned.

Figure 13:
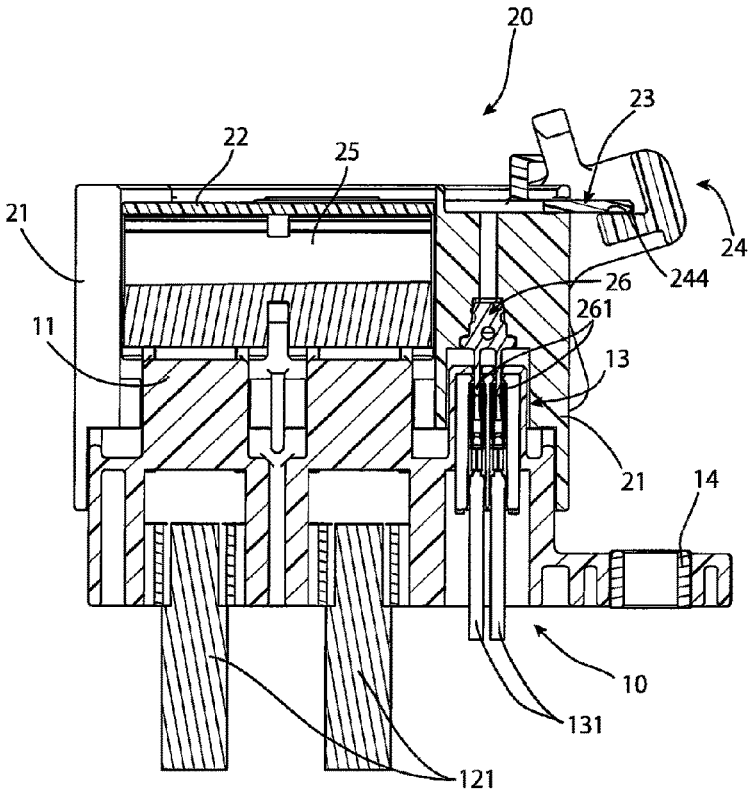
FIG. 13 is a side sectional view taken along arrows YY-YY of FIG. 11A-2.

FIG. 13 is a cross sectional view taken along arrows YY-YY shown in FIG. 11(A-2) after completion of the first-half turning operation. At the end of the first-half turning operation of the lever 24, the male contact portions 261 of the interlock busbar 26 have been pulled out from the interlock connector 13. Thereby, the short circuit of the two conducting wires 131 is removed.

Figure 14:
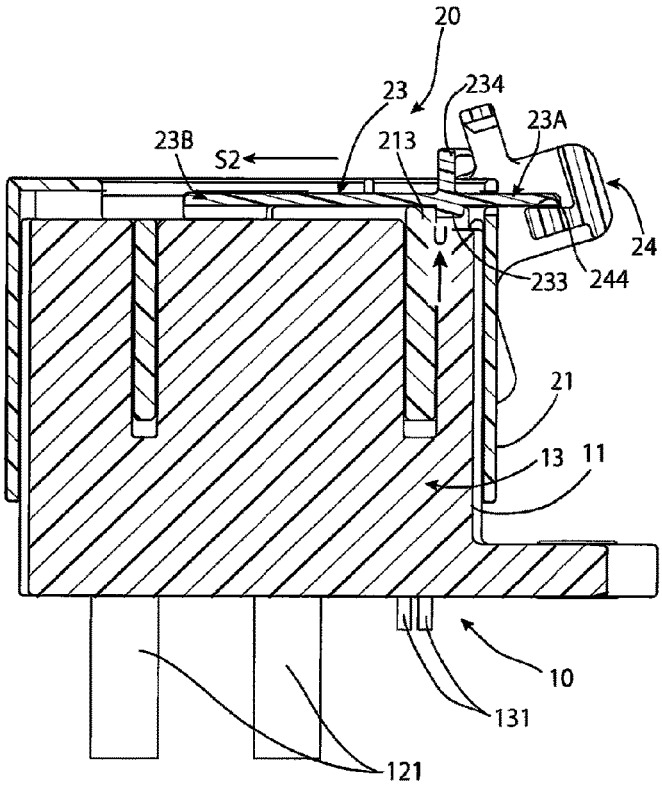
FIG. 14 is a side sectional view taken along arrows ZZ-ZZ of FIG. 11A-2.

FIG. 14 is a cross sectional view taken along arrows ZZ-ZZ shown in FIG. 11(A-2) after completion of the first-half turning operation. After the first-half turning operation of the lever 24 is completed, then the sliding operation of the slider 23 toward the separation position is performed. As shown in FIG. 14, however, even if sliding the slider 23 simply in the direction of the arrow S2 is tried, the slider 23 cannot be slid since the slide lock protrusions 233 abut against the abutting wall 213. Therefore, the lock portion 23A of the slider 23 is now lifted in a direction indicated by an arrow U by putting a finger on the finger catch portion 234 of the slider 23. This operation of lifting the slider 23 is equivalent to an example of a removing operation. Because of the first-half turning operation of the lever 24, the hook portions 243 of the lever 24 have been pulled out from the catching holes 232 of the slider 23 and are located away from the slider 23. Therefore, when the finger catch portion 234 of the slider 23 is lifted, the leg portions 23B of the slider 23 are deflected, and the lock portion 23A is lifted to a height at which the slide lock protrusions 233 can get over the abutting wall 213. The sliding operation of the slider 23 in the direction of the arrow S2 is performed while the slider 23 is being lifted.

If lifting the slider 23 is tried without the turning operation of the lever 24, namely, in the state shown in FIG. 6(C-1), as shown in FIG. 10, the hook portions 243 of the lever 24 located inside the catching holes 232 of the slider 23 block the slider 23 from being lifted.

Figure 15:
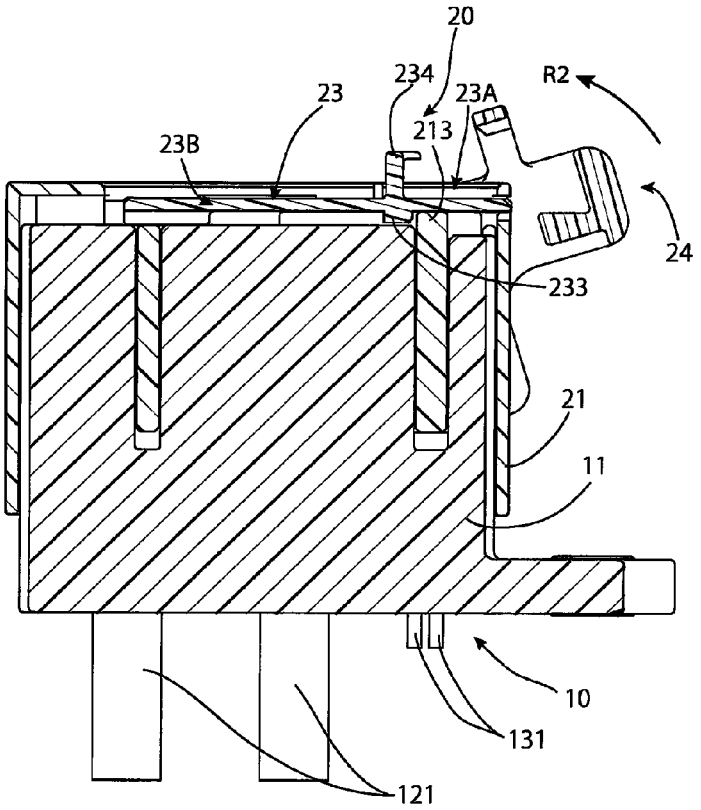
FIG. 15 is a side sectional view taken along arrows ZZ-ZZ of FIG. 11A-2 with the slider in the separation position.

FIG. 15 is a cross-sectional view taken along the arrows ZZ-ZZ shown in FIG. 11(A-2) where the slider has been slid to the separation position. In such a manner as described with reference to FIG. 14, the lock portion 23A of the slider 23 is lifted and the slider 23 is slid in the direction of the arrow S2. According to this operation, the slider 23 moves to the separation position shown in FIG. 15. Thereupon, the lever 24 becomes turnable again in the direction of the arrow R2, and according to the second-half turning operation, the lever 24 is put into a vertically oriented state shown in FIG. 11(C). By this second-half turning operation of the lever 24, the pair of terminals 12 pinched by the clip busbar 25 is released from the pinch, and the short circuit of the two conducting wires 12 is opened.

In the unmating operation of the connector assembly described herein, the first-half turning operation and the second-half turning operation of the lever 24 are separated, and the necessary sliding operation of the slider 23 is interposed between these first-half and second-half turning operations. Therefore, the short circuit of the two conducting wires 131 for signal transmission is removed and, after a period of time equal to or longer than a period of time until the electrical conduction to the terminals 12 is interrupted reliably elapses, the short circuit of the terminals 12 is removed.

What is claimed is:

1. A connector configured to be detachably mated with a mating connector, the mating connector including an interlock connector retaining ends of a pair of first conducting wires, a pair of terminals fixed to respective ends of a pair of second conducting wires, and a mating housing accommodating the interlock connector and the pair of terminals, comprising:

an interlock busbar adapted to be inserted into the interlock connector and short-circuit the pair of first conducting wires;

a clip busbar adapted to pinch and short-circuit the pair of terminals;

a housing accommodating the interlock busbar and the clip busbar;

a lever for being operated in a turning manner to mate with and unmate from the mating connector, the lever removes the short circuit of the pair of first conducting wires by pulling out the interlock busbar from the interlock connector, while the pair of terminals are being pinched and short-circuited by the clip busbar, according to a first-half turning operation in an unmating direction of the lever from a mating state with the mating connector; and a slider supported on the housing and capable of being operated in a sliding manner between an unmating position and a mating position, the slider at the mating position blocks a second-half turning operation following the first-half turning operation of the lever by interfering with the lever at an end of the first-half turning operation of the lever, and allows the second-half turning operation of the lever after a sliding operation of the slider to the unmating position.

2. The connector of claim 1, wherein the slider includes a slide lock protrusion blocking the slider at the unmating position from sliding to the mating position by interfering with the housing when the connector is in an unmated state with the mating connector.

3. The connector of claim 2, wherein the slider is pushed by the mating connector during mating with the mating connector to remove blocking of the slider at the unmating position.

4. The connector of claim 3, wherein the slider is blocked from sliding to the unmating position by interference between the slide lock protrusion and the housing and a removing operation for removing the interference between the slide lock protrusion and the housing is also blocked by interference between the slider and the lever when the connector is in the mating state with the mating connector and the slider is at the mating position.

5. The connector of claim 4, wherein the first-half turning operation of the lever enables the removing operation.

6. A connector assembly, comprising:

a first connector including:

an interlock connector retaining ends of a pair of first conducting wires;

a pair of terminals fixed to respective ends of a pair of second conducting wires; and a mating housing accommodating the interlock connector and the pair of terminals; and a second connector matable with the first connector and including:

an interlock busbar adapted to be inserted into the interlock connector and short-circuit the pair of first conducting wires;

a clip busbar adapted to pinch and short-circuit the pair of terminals;

a housing accommodating the interlock busbar and the clip busbar;

a lever for being operated in a turning manner to mate with and unmate from the first connector, the lever removes the short circuit of the pair of first conducting wires by pulling out the interlock busbar from the interlock connector, while the pair of terminals are being pinched and short-circuited by the clip busbar, according to a first-half turning operation in an unmating direction of the lever from a mating state with the first connector; and a slider supported on the housing and capable of being operated in a sliding manner between an unmating position and a mating position, the slider at the mating position blocks a second-half turning operation following the first-half turning operation of the lever by interfering with the lever at an end of the first-half turning operation of the lever, and allows the second-half turning operation of the lever after a sliding operation of the slider to the unmating position.

* * * * *